US009470221B2

(12) United States Patent
Merzhauser et al.

(10) Patent No.: US 9,470,221 B2
(45) Date of Patent: Oct. 18, 2016

(54) PERISTALTIC HOSE PUMP

(71) Applicant: W.O.M. World of Medicine GmbH, Berlin (DE)

(72) Inventors: Thomas Merzhauser, Berlin (DE); Joachim Sasse, Falkensee (DE); Stefan Kurbis, Mahlow (DE); Peter Zentner, Berlin (DE); Heinz Hemesath, Berlin (DE)

(73) Assignee: W.O.M. WOLRD OF MEDICINE GMBH, Berlin (DE)

( * ) Notice: Subject to any disclaimer, the term of this patent is extended or adjusted under 35 U.S.C. 154(b) by 0 days.

(21) Appl. No.: 14/589,597

(22) Filed: Jan. 5, 2015

(65) Prior Publication Data

US 2015/0198152 A1 Jul. 16, 2015

Related U.S. Application Data

(63) Continuation of application No. 12/965,185, filed on Dec. 10, 2010, now abandoned.

(30) Foreign Application Priority Data

Dec. 11, 2009 (DE) ..... 10 2009 058 279

(51) Int. Cl.

| | |
|---|---|
| ***F04B 43/12*** | (2006.01) |
| ***F04B 49/035*** | (2006.01) |
| ***F04B 49/24*** | (2006.01) |
| ***F04B 49/22*** | (2006.01) |

(52) U.S. Cl.

CPC ..... *F04B 43/12* (2013.01); *F04B 43/1253* (2013.01); *F04B 49/035* (2013.01); *F04B 49/22* (2013.01); *F04B 49/24* (2013.01); *F04B 2205/01* (2013.01); *F04B 2205/09* (2013.01)

(58) Field of Classification Search

CPC ..... F04B 43/12–43/1292; F04B 49/22; F04B 49/24; F04B 49/035; F04B 2205/09; F04B 2205/01

See application file for complete search history.

(56) References Cited

U.S. PATENT DOCUMENTS

| | | | | |
|---|---|---|---|---|
| 3,877,609 | A * | 4/1975 | Cullis | F04B 23/10 222/1 |
| 4,537,561 | A | 8/1985 | Xanthopoulos | |
| 4,798,580 | A | 1/1989 | Demeo | |
| 5,044,902 | A | 9/1991 | Malbec | |

(Continued)

FOREIGN PATENT DOCUMENTS

| | | |
|---|---|---|
| DE | 19960668 C1 | 8/2001 |

*Primary Examiner* — Peter J Bertheaud
*Assistant Examiner* — Dnyanesh Kasture
(74) *Attorney, Agent, or Firm* — Karin L. Williams; Mayer & Williams PC

(57) ABSTRACT

A method for generating a flow by a peristaltic hose pump, a generated fluid pressure being limited to 500 mbar and being achieved and maintained without a pressure measurement during operation of the pump. A length of a flexible and elastic pump segment of a hose is adjusted such that, while a roller wheel is stationary, and while the segment is guided under tension around the roller wheel, and when applying a fluid pressure in the range from 10 to 400 mbar to one end of the pump segment, a backflow leakage in the opposite direction to the direction of rotation of the roller wheel is created, and a flow of the fluid of at least 0.01 l/min through the pump segment is obtained, taking into account the backflow leakage. The distance of fixing points of each end of the pump segment to the roller wheel rotation axis is fixed.

20 Claims, 2 Drawing Sheets

(56) References Cited

U.S. PATENT DOCUMENTS 5,052,900 A 10/1991 Austin
5,213,483 A 5/1993 Flaherty
5,215,450 A * 6/1993 Tamari ..... A61M 1/0031 138/119
7,168,930 B2 * 1/2007 Cull ..... F04B 43/1261 417/477.11
2008/0154182 A1 6/2008 Martin
2010/0150759 A1 * 6/2010 Mazur ..... F04B 43/0072 417/477.13

* cited by examiner

PERISTALTIC HOSE PUMP

CROSS REFERENCE TO RELATED APPLICATION

This application is a continuation of U.S. application Ser. No. 12/965,185, filed Dec. 10, 2010 entitled PERISTALIC HOSE PUMP, which claims priority to German Application No. 10 2009 058 279.7, filed Dec. 11, 2009. Said applications are incorporated herein by reference.

FIELD OF THE INVENTION

The invention concerns a peristaltic hose pump, in particular for use in the field of medicine, comprising a roller wheel, which can be driven about a roller wheel axis, and which has rollers that are mounted thereon, the roller wheel rotation axes of which are arranged on a circle concentric with the roller wheel axis, the rollers partly projecting beyond the roller wheel, comprising a hose, which has a flexible and elastic pump segment, the pump segment being fixable in the axial direction at its two opposite ends by means of one fixing point each, and the pump segment being guided around the roller wheel under elastic tension. The invention further concerns the use of such a peristaltic hose pump for generating fluid flow through medical instrument.

BACKGROUND OF THE INVENTION AND PRIOR ART

Peristaltic hose pumps of the construction mentioned above are known in various variants. There are in principle two basic concepts. The first basic concepts that the hose Arranged around the roller wheel is pressed by means of pressure arched element or the like against the roller wheel. Such embodiments are for instance known from the documents U.S. Pat. No. 4,798,580 and U.S. Pat. No. 5,044,902. The second basic concept, on which the invention is based, consists in that the elastic hose is pulled by a tensile force of suitable size with a sufficient angle of wrapping, typically more than 90° and less than 270°, in most cases in the range from 150° to 220°, around the roller wheel. Thereby, a pressure arched element or the like is not necessary. The tensile force is dimensioned according to the elastic properties of the hose such that in the region of a roller of a roller wheel, the interior cross-section of the hose is reduced to practically zero. By rotation of this region with the roller about the roller wheel axis, the feed of the fluid in the hose is effected. Examples are described in the documents U.S. Pat. No. 4,537,561 and U.S. Pat. No. 5,213,483. A particularly advantageous variant of the second basic concept is described in the document DE 19960668 A1.

It is common to all above peristaltic hose pumps that across a broad range there is a nearly linear correlation between the speed of the roller wheel and the flow, and in fact independently from the generated pressure respectively counter-pressure. In these connections it is however also known that with very high pressures respectively counter-pressures, typically above 530 mbar, the correlation between speed and flow becomes non-linear.

When using peristaltic hose pumps in the field of medicine, for instance for generating a flow through a body cavity by introduction of a medical instrument, which is fed by means of the peristaltic hose pump with fluid, the pressure respectively counter-pressure is a critical parameter. A doctor wishes on the one hand a high flow for rinsing the body cavity. On the other hand, a certain pressure is in fact desirable for expanding the body cavity, this pressure is however also a very critical parameter. Approx. 500 mbar, better 400 mbar, should definitely not be exceeded. Typical pressures, which are medically harmless, are in the range from approx. 50 to 300 mbar.

For peristaltic hose pumps of prior art construction, comprehensive safety measures are provided, in order to safely prevent an inadmissible pressure rise in a body cavity when adjusting a high flow. Typically, a pressure sensor is provided, which regularly monitors the pressure in the body cavity and/or the feed line to the medical instrument respectively the pressure side of the peristaltic pump and adjusts the drive of the roller wheel to smaller speeds, if the pressure is too high. It is even possible that the roller wheel is adjusted to reverse operation in the case of a strong pressure rise in the body cavity. This will in particular take place, when an inadmissibly high pressure could occur at a very small flow already.

The above measurement and control measures are all in all expensive, thus prior art peristaltic hose pumps being costly. It would be desirable to provide a peristaltic hose pump for use in the field of medicine, the roller wheel speed of which is preselectable and otherwise constant, and in which a defined limit pressure cannot be exceeded for any of the preselectable speeds, and in fact without the necessity of suitable pressure sensors and control of the speed of the roller wheel.

TECHNICAL OBJECT OF THE INVENTION

It is therefore the technical object of the invention to propose a peristaltic hose pump, which can be obtained in a simple construction, in particular does not need measurements of the pressure in the body cavity respectively on the pressure side of the peristaltic pump, nor control measures for the drive of the roller wheel, and which nevertheless safely excludes that a given maximum limit pressure is exceeded.

SUMMARY OF THE INVENTION AND PREFERRED EMBODIMENTS

For achieving this technical object, the invention teaches a peristaltic hose pump comprising a roller wheel, which can be driven about a roller wheel axis, and which has rollers that are mounted thereon, the roller wheel rotation axes of which are arranged on a circle concentric with the roller wheel axis, the rollers partly projecting beyond the roller wheel, comprising a hose, which has a flexible and elastic pump segment, the pump segment being fixable in the axial direction at its two opposite ends by means of one fixing point each, and the pump segment being guided around the roller wheel under elastic tension, wherein the length of the pump segment when not under tension in proportion to the distance of the fixing points to the roller wheel rotation axis is adjusted with the provision that while the roller wheel is stationary and when applying a fluid pressure in the range from 10 to 400 mbar to one end of the pump segment, a flow of the fluid of at least 0.01 l/min through the pump segment is obtained.

The roller wheel is typically set into rotation by means of an electric motor drive, thereby the cross-section of the pump segment of the hose being reduced in the region of a roller. The speed of the roller wheel may be unregulated, for instance by applying a preselectable voltage (for analogous electric motors) or frequency (for stepper motors) to the electric motor drive. It is also possible to keep the speed of the roller wheel constant at a preselectable speed by a control loop. Then, a transducer, for instance a speed to dial, is typically arranged on the shaft of the roller wheel, by means of which a speed signal is generated. This speed signal is then compared in an analog or digital comparator with a preselected nominal signal. When the speed signal indicates a too low speed, compared with the nominal speed correlated with the nominal signal, the comparator increases the voltage respectively the frequency, which is applied to the electric motor drive. An essential element of the invention is that this control or regulation does not obtain nor need as input signal a signal of a pressure sensor arranged on the pressure side of the peristaltic hose pump.

A pump segment of a hose is a partial length of the hose, which is made of an elastic and flexible material. At the ends of the pump segment respectively follow partial lengths of the hose, which in most cases, but not necessarily are made of another material and/or are differently dimensioned. The partial length of the hose, which forms the pump segment, is limited and defined by the fixing points. The fixing points are disposed in the geometric layout, related to directions orthogonal to the roller wheel axis, at defined and fixed points in the peristaltic pump. Thereby, the hose segment of a certain length is, after guiding it around the roller wheel, under an elastic tension given according to the length.

The invention is based first of all on the finding that the reason for the non-linearity between speed and flow at high pressures is that with very high pressures, the interior cross-section of the hose respectively of the pump segment is reduced not to zero anymore in the region of a roller of the roller wheel because of the (counter-) pressure. Because of the pressure, there is therefore a backflow, referred to the reduced interior cross-section of the pump segment and the revolution thereof about the roller wheel axis, in opposition to the direction of rotation of the roller wheel and consequently the feed direction of the peristaltic hose pump. This backflow in turn is a function of the pressure and becomes the higher, the higher the pressure on the pressure side of the hose pump is.

The invention makes use of this finding for adjusting a maximum attainable pressure in medically compatible pressure ranges, i.e., below 400 mbar, preferably below 300 mbar, by allowing the provision of a backflow at normal operating conditions already. By the fact that even while the roller wheel is stationary, a flow is already made possible, so to speak a defined back flow leakage in the region of the reduced interior cross-section of the pump segment in the region of a roller is provided. This back flow leakage acts quasi as a bypass valve from the pressure side to the feeding side of the hose.

By a peristaltic hose pump according to the invention, it is achieved that with simplest design, namely without pressure-controlled regulation of the roller wheel drive and without pressure measurement and indication, nevertheless a hose pump for medical purposes meeting all safety requirements is obtained. A peristaltic hose pump according to the invention can thus be produced very cost-effectively. Further, its handling is extremely simple, since an operator only needs to select a defined speed, at which the roller wheel then constantly turns until another preselection. Even with maximum preselected speed, exceedance of a defined maximum admissible pressure value is inherently excluded.

Essential for the invention is the set-up of the length of the elastic pump segment when not under tension in proportion to the distance of the fixing points to the roller wheel rotation axis. In other words, the set-up comprises the proportion of the length of the pump segment when not under tension to the length of the pump segment when the pump segment is guided under tension around the roller wheel by means of the fixing points.

The set-up can in principle be provided in two different ways. On the one hand it is possible to vary the length of the pump segment when not under tension with fixing points being invariable with respect to the roller wheel axis. By a test series with different lengths of the pump segment when not under tension it can be tested, whether the flow according to the invention is provided when the pump segment is guided under tension around the roller wheel and while the roller wheel is stationary. Alternatively, with invariant length of the pump segment, the distance of a fixing point or the distances of both fixing points with respect to the roller wheel rotation axis can be varied and adjusted in a test series so that the flow according to the invention when the pump segment is guided under tension around the roller wheel and while the roller wheel is stationary. Depending on the employed hose material for the pump segment and its dimensions, the provision according to the invention can easily be adjusted by tests and assignment to the respective constructional design of the pump segment.

In a peristaltic hose pump according to the invention, usually the distance of the fixing points to the roller wheel rotation axis will not be adjustable. Rather, regularly the length of the pump segment when not under tension is adapted thereto in the above manner. For test purposes respectively for the test series mentioned above of the second alternative, it is however also possible that a peristaltic hose pump is designed such that the distance of at least one fixing point to the roller wheel rotation axis is adjustable.

For the purpose of a peristaltic hose pump according to the invention, other hoses can also be used. With unchanged distance of the fixing points to the roller wheel rotation axis, the length of the hose segment has been determined and adapted in a corresponding way for every type of a hose respectively hose segment. This may in particular have been made for instance with a hose cassette according to the document DE 199 60 668 A1, to which herewith reference comprehensively is made.

Preferably, it is provided that while the roller wheel is stationary and when applying a fluid pressure in the range from 10 to 300 mbar, preferably from 10 to 200 mbar to one end of the pump hose segment, a flow of the fluid from 0.01 l/min to 1 l/min, preferably to 0.5 l/min, most preferably to 0.1 l/min is obtained.

Alternatively respectively preferably, the set-up of the length of the pump segment when not under tension in proportion to the distance of the fixing points to the roller wheel axis is made with the provision that with maximum speed of the roller wheel and closed pressure side of the hose, a pressure of not more than 500 mbar, preferably of not more than 450 mbar, most preferably not more than 400 mbar, in particular not more than 350 mbar or 300 mbar, appears on the pressure side. In addition to this, an optimization of the flow can also simultaneously be made such that with the above maximum pressures a maximum flow, for instance of more than 0.6 l/min, preferably more than 0.7 l/min, most preferably more than 0.8 l/min, in particular more than 0.9 l/min, for instance more than 1.0 l/min, is achieved.

As an additional safety measure against inadmissibly high pressures, a bypass line with a pressure-controlled bypass valve can be arranged between the regions of the ends of the pump segment. The bypass valve can open at a pressure from 100 to 500 mbar, preferably 200 to 400 mbar, most preferably 300 to 350 mbar. The clear cross-section of the bypass line with opened bypass valve can be 10 to 100%, preferably 20 to 50%, of the clear cross-section of the pump segment when not under tension. The clear cross-section is the total passage area for the fluid.

Typically the following materials can be used for the pump segment: elastomeric silicone polymers, soft PVC or similar materials, which are known to the man skilled in the art. Typical inner diameters are in the range from 6 to 10 mm, preferably 7 to 9 mm, for instance 8 mm. Typical wall thicknesses are in the range from 1 to 2 mm, for instance 1.5 mm.

The invention also concerns the use of a peristaltic hose pump according to the invention for generating a fluid flow through a medical instrument, wherein a fluid source is connected at a feeding side of the hose, wherein the medical instrument is connected at a pressure side of the hose and wherein the roller wheel is driven with a preselected and constant speed for feeding the fluid from the feeding side to the pressure side. For the preselection, typically a rotary switch or a key pad can be provided, and to each switch po-sition respectively each key, a defined constant speed of the roller wheel is assigned, and the electric motor drive of which is correspondingly controlled. Instead of a rotary switch, a continuous control element, such as for instance a potentiometer, can also be provided. Of course, a digital entry respectively preselection of the speed by means of an input field is also possible.

Preferably, the fluid source is a fluid container, which is arranged, preferably by 0.1 to 2 m, most preferably 0.1 to 1 m, above the higher end of the pump segment, the fluid container communicating with the feeding side of the hose without interposed pump. The hose pump acts quasi as a booster for the hydrostatic pressure resulting from the arrangement of the fluid container. Compared to the classic bag suspension and height adjustment without pump, an increased flow through the medical instrument achieved being often medically desirable.

BRIEF DESCRIPTION OF THE DRAWINGS

In the following, the invention is explained in more detail with reference to figures representing an example of execution only. There are.

DETAILED DESCRIPTION

Figure 1:
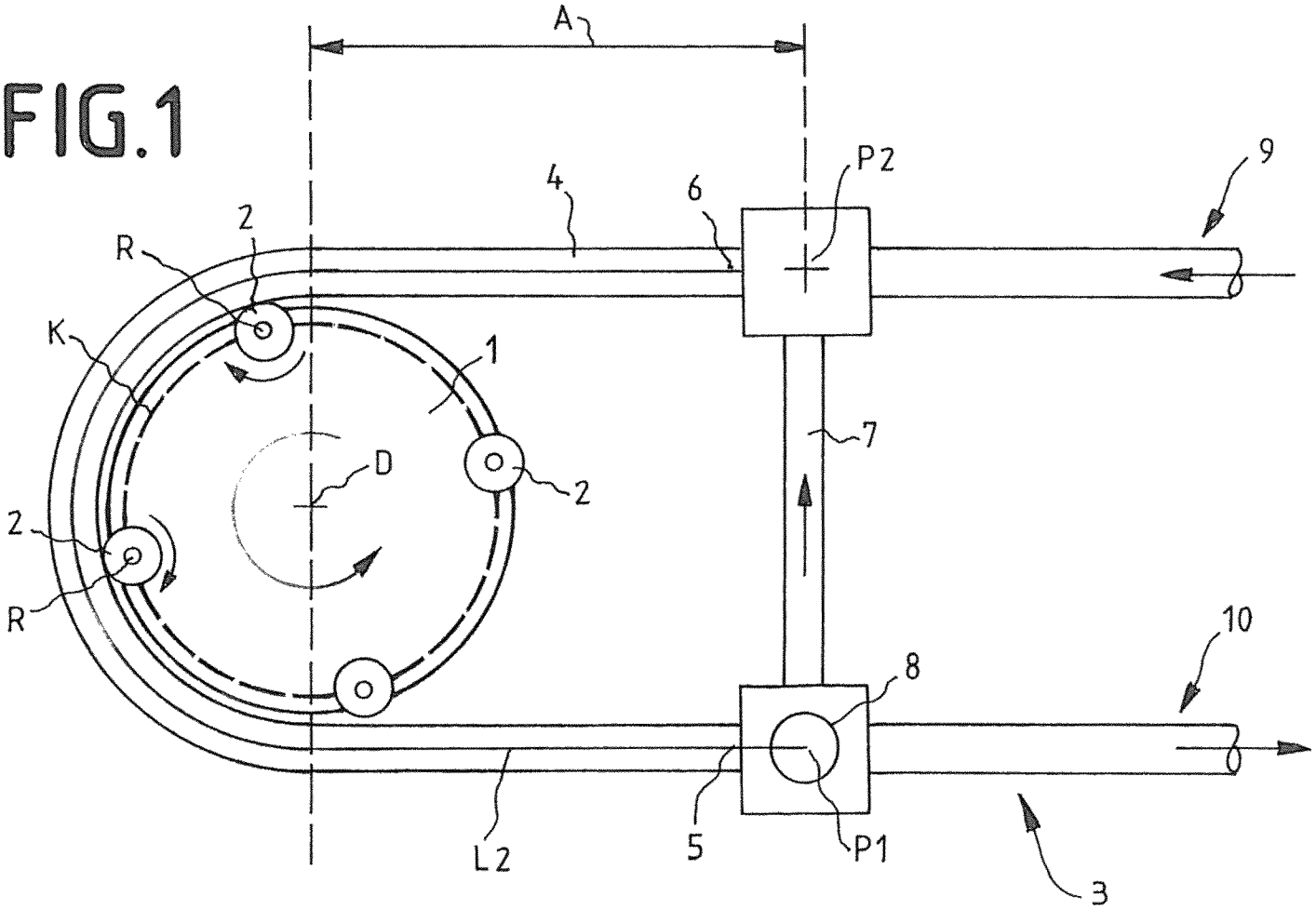
FIG. 1: a schematic view of a peristaltic hose pump according to the invention.

In FIG. 1 it can first be seen that the peristaltic hose pump comprises a roller wheel 1 which can be driven about a roller wheel axis D, said roller wheel 1 having rollers 2 that are mounted thereon, the roller wheel rotation axes of which R being arranged on a circle concentric with the roller wheel axis D, the rollers 2 partly projecting beyond the roller wheel 1. The roller wheel axis D and the roller wheel rotation axes R extend in parallel to each other. For reasons of clarity, the electric motor drive of the roller wheel is not shown, which is supplied with preselectable operating voltages. For this purpose, suitable power supply circuits are provided.

Furthermore, a hose 3 is provided, which has a flexible and elastic pump segment 4, in the embodiment made of an elastomeric silicone polymer. The pump segment 4 is fixed at its two opposite ends 5, 6 in the axial direction, referred to the pump segment, by means of one fixing point P1, P2 each. The fixing points P1, P2 can allow a rotation of the end of the pump segment 4 about an axis orthogonal to the axial direction of the pump segment 4.

In the representation of FIG. 1, the pump segment 4 is shown in mounted condition, i.e. guided under elastic tension around the roller wheel 1 and when under tension. When under tension, the pump segment 4 has the length L2. When not under tension, i.e. not guided around the roller wheel 1, the pump segment 4 has a length L1 (not shown). The length L1 is smaller than the length L2. The length is herein the longitudinal extension of the center axis through the pump segment 4.

The length L1 of the pump segment 4 when not under tension is adjusted in proportion to the distance A of the fixing points P1, P2 to the roller wheel axis D respectively to the length L2 with the provision that while the roller wheel 1 is stationary and when applying a fluid pressure in the range of 100 mbar to one end P1, P2 of the pump segment 4, a flow of the fluid of approx. 0.3 l/min through the pump segment 4 is obtained.

For adjusting the above provision respectively for carrying-out test series for determining the suitable length L2, the distance A of one or both fixing points P1, P2 to the roller wheel rotation axis D can be adjustable. Usually, however, the distance A will not be adjustable, and the length L1 of the pump segment 4 has been adapted correspondingly in previous tests.

Furthermore, it can be seen in FIG. 1 that a bypass line 7 with a pressure-controlled bypass valve 8 is arranged between the regions of the ends 5, 6 of the pump segment 4. The bypass valve 8 opens at a pressure of approx. 300 mbar. By means of the bypass line 8 and the bypass valve 8, if applicable an additional backflow for the pressure relief of the pressure side 10 is provided. The bypass valve 8 may be carried out in most various ways. In the simplest case, it is a pressure-dependent mechanical control element, having a valve seat and a spring-loaded closing element that without any further control from outside opens against the spring force or closes with the spring force. By pressure application to the closing element, the latter will be moved against the spring force, when a predetermined maximum pressure value defined by the spring force is exceeded, and will come free from valve seat, so that fluid can drain respectively flow back from the pressure side through the bypass valve 8. Alternatively, the bypass line 7 may be a flexible hose, which extends in a clamping element. Such a clamping element comprises a supporting surface, against which the bypass line 7 rests, and a clamping actuator, which for instance can be driven by an electric motor, and which is pressed on the bypass line 7 on the side of the bypass line 7 opposite to the supporting surface and compresses the bypass line 7 against the supporting surface. Thereby, a continuous variation of the flow cross-section through the bypass line 7 and thus a continuous variation of the pressure can be obtained.

Figure 2:
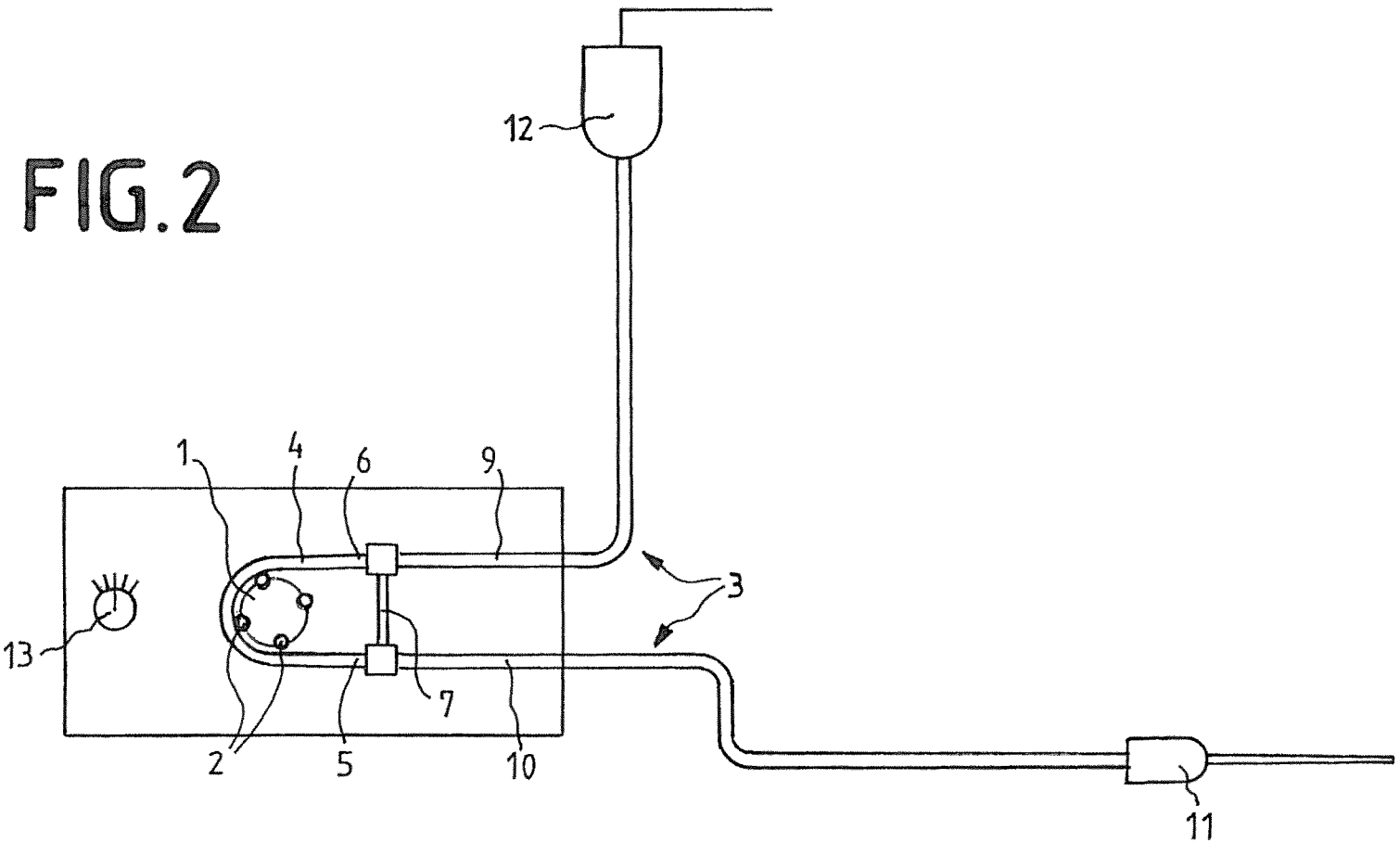
FIG. 2: the arrangement when using a peristaltic hose pump according to the invention in the field of medicine.

In FIG. 2, the use of the peristaltic hose pump according to the invention for generating a fluid flow through a medical instrument 11 is shown. At the feeding side 9 of the hose 3, a fluid source 12 is connected. At the pressure side 10 of the hose 3, the medical instrument 11 is connected, the end of which can for instance be introduced into a not shown body cavity. The roller wheel 1 is driven with a preselected and constant speed for feeding the fluid from the feeding side 9 to the pressure side 10. For preselecting the desired constant speed, a rotary switch 13 is provided. Of course, instead of a rotary switch 13, a continuously operating actuator can also be provided. In FIG. 2 it can further be seen that the fluid source is a fluid container 12, which is arranged approx. 1 m above the end 6 of the pump segment 4. Between the fluid container 12 and the feeding side 9 of the hose 3, there is no pump or the like interposed.

In particular in FIG. 2 can be seen that a peristaltic hose pump according to the invention basically effects an increase of the hydrostatic pressure provided by the fluid container 12.

In the following, a test series for determining a suitable length L2 is described. For this purpose, a peristaltic hose pump of the basic design of FIG. 1 was used. By a manually operated spindle drive, the distance A of the two fixing points P1, P2 could be varied. A change of the distance A therefore corresponds to a change of the length L2 by twice the change of the distance A. Besides that, it is a standard hose pump and a standard pump segment 4.

The measurements were made with a structure according to FIG. 2 by means of a standard instrument as medical instrument, which was introduced into a dummy representing a body cavity. The dummy comprised an outflow cock. First, the flow with opened outflow cock was measured. Then the outflow cock was closed, and the resulting pressure in the dummy was measured. The fluid container was arranged at a level of approx. 1 m above the fixing point P1. The dummy was approx. at the level of the fixing point P1. The data in Table 1 were obtained.

The parameter A is given in arbitrary relative units. Speed is the speed of the roller wheel. Graviflow designates the flow while the roller wheel is stationary. Flow indicates the maximum flow with opened out flow cock. Pressure in the dummy indicates the maximum pressure in the dummy with closed outflow cock. The values in parentheses are measured values that were taken again after 2 hours elapsed.

TABLE 1

| A [mm] | Speed [UpM} | Graviflow (l/min] | Flow [l/min] | Pressure in the dummy [mbar] |
|---|---|---|---|---|
| −2 | 50 | 0.46 | 0.35 (0.40) | 104 (103) |
| −2 | 100 | 0.46 | 0.50 (0.50) | 108 (117) |
| −2 | 150 | 0.46 | 0.50 (0.50) | 120 (138) |
| −2 | 200 | 0.46 | 0.55 (0.55) | 133 (159) |
| −2 | 300 | 0.46 | 0.60 (0.70) | 172 (212) |
| 0 | 50 | 0.33 | 0.40 (0.35) | 130 (139) |
| 0 | 100 | 0.33 | 0.50 (0.50) | 178 (208) |
| 0 | 150 | 0.33 | 0.55 (0.60) | 234 (258) |
| 0 | 200 | 0.33 | 0.70 (0.75) | 280 (305) |
| 0 | 300 | 0.33 | 0.90 (1.00) | 371 (391) |
| 2 | 50 | 0.22 | 0.30 (0.25) | 172 (212) |
| 2 | 100 | 0.22 | 0.50 (0.55) | 308 (323) |
| 2 | 150 | 0.22 | 0.70 (0.75) | 401 (397) |
| 2 | 200 | 0.22 | 0.80 (0.85) | 482 (461) |
| 2 | 300 | 0.22 | 1.20 (1.20) | 580 (559) |
| 4 | 50 | 0 | 0.25 (0.25) | 270 (322) |
| 4 | 100 | 0 | 0.50 (0.55) | 462 (450) |
| 4 | 150 | 0 | 0.75 (0.75) | 558 (551) |
| 4 | 200 | 0 | 1.00 (1.00) | 662 (620) |
| 4 | 300 | 0 | 1.40 (1.35) | 772 (738) |
| 6 | 50 | 0 | 0.25 (0.25) | 270 (404) |
| 6 | 100 | 0 | 0.50 (0.55) | 596 (584) |
| 6 | 150 | 0 | 0.75 (0.75) | 743 (712) |
| 6 | 200 | 0 | 1.05 | 800 |

It can be seen that for A=−2, 0 and 2, the roller wheel 1 does not seal the pump segment 4. For A=−2, the attainable flow is relatively low. For A=0, the attainable flow is satisfactory. For A=−2 and 0, there are no maximum pressures of more than 400 mbar. The optimum adjustment is therefore A=0.

What is claimed is:

1. A method for generating a flow through a body cavity by introduction of a medical instrument, the flow being generated by a peristaltic hose pump, a generated fluid pressure being limited to 500 mbar, said pressure being achieved and maintained without a pressure measurement obtained by a pressure sensor during operation of the peristaltic hose pump, the method including:

an adjusting step for adjusting a hose, having a flexible and elastic pump segment, the pump segment having two respective opposite ends, each end being fixable in a direction along a same line as a roller wheel rotatable about a roller wheel axis by means of one fixing point (P1, P2) each, and the pump segment being guided around the roller wheel under elastic tension, wherein a length of the pump segment, is adjusted such that while the roller wheel is stationary, and while the pump segment is guided under tension around the roller wheel, and when applying a fluid pressure in the range from 10 to 400 mbar to one end (P1, P2) of the pump segment, a backflow leakage in the opposite direction to the direction of rotation of the roller wheel is created, and a flow of the fluid of at least 0.01 l/min through the pump segment is obtained, taking into account the backflow leakage, and an operation step, wherein the peristaltic hose pump is operated in order to generate flow of 0.1-1 l/min through a body cavity with a maximum pressure of 500 mbar, and in which the distance of each of the fixing points to the roller wheel rotation axes is fixed.

2. The method of claim 1, wherein a flow of 0.5 l/min is generated.

3. The method of claim 1, wherein the distance of at least one fixing point to the roller wheel axis is adjustable.

4. The method of claim 1, wherein while the roller wheel is stationary and when applying a fluid pressure in the range from 10 to 300 mbar, to one end of the pump segment, a flow of the fluid from 0.01 l/min to 1 l/min is obtained.

5. The method of claim 1, further comprising the step of arranging a bypass line with a pressure-controlled bypass valve between regions of the ends of the pump segment.

6. The method of claim 5, wherein the bypass valve opens at a pressure from 100 to 500 mbar.

7. The method of claim 5, wherein the minimum clear cross-section of the bypass line with opened bypass valve is 10 to 100%, of the clear cross-section of the pump segment when not under tension.

8. The method of claim 5, wherein said pressure-controlled bypass valve comprises a pressure-dependent mechanical control element that opens and closes without user input.

9. The method of claim 1 for generating a flow through a body cavity, further comprising the steps of connecting a fluid source at a feeding side of the hose, wherein a pressure side of the hose is inserted into the body cavity, and wherein the roller wheel is driven with a preselected and constant speed for feeding the fluid from the feeding side to the pressure side.

10. The method of claim 9, wherein the fluid source is a fluid container, and further comprising the step of arranging the fluid container 0.1 to 2 m above a higher end of the pump segment, the fluid container communicating with the feeding side of the hose without an interposed pump.

11. The method of claim 1, wherein said peristaltic hose pump operates creates and maintains a fluid pressure limited to 500 mbar without a pressure measurement obtained by a pressure sensor during operation of the peristaltic hose pump.

12. A method for generating a flow by a peristaltic hose pump, a generated fluid pressure being limited to 500 mbar, said pressure being achieved and maintained without a pressure measurement obtained by a pressure sensor during operation of the peristaltic hose pump, the method comprising the steps of:

adjusting a hose, the hose having a flexible and elastic pump segment having two respective opposite ends, each respective end being fixable by means of one fixing point each, wherein a length of the elastic pump segment when not guided under tension around a roller wheel having a rotation axis, in proportion to the distance of each of the fixing points to the roller wheel rotation axis, is adjusted such that, while the roller wheel is stationary, and while the pump segment is guided under tension around the roller wheel, and when applying a fluid pressure in the range from 10 to 400 mbar to one end (P1, P2) of the pump segment, a backflow leakage in the opposite direction to the direction of rotation of the roller wheel is created, and a flow of the fluid of at least 0.01 l/min through the pump segment is obtained, taking into account the backflow leakage, and operating the hose pump, wherein the peristaltic hose pump is operated in order to generate flow of 0.1-1 l/min through a body cavity with a maximum pressure of 500 mbar, and in which the distance of each of the fixing points to the roller wheel rotation axis is fixed.

13. The method of claim 12, wherein a flow of 0.5 l/min is generated.

14. The method of claim 12, wherein the distance of at least one fixing point to the roller wheel axis is adjustable.

15. The method of claim 12, further comprising the step of arranging a bypass line with a pressure-controlled bypass valve between regions of the ends of the pump segment.

16. The method of claim 15, wherein the minimum clear cross-section of the bypass line with opened bypass valve is 10 to 100%, of the clear cross-section of the pump segment when not under tension.

17. The method of claim 15, wherein said pressure-controlled bypass valve comprises a pressure-dependent mechanical control element that opens and closes without user input.

18. The method of claim 12 for generating a flow, further comprising the steps of connecting a fluid source at a feeding side of the hose, wherein a medical instrument is connected at a pressure side of the hose, and wherein the roller wheel is driven with a preselected and constant speed for feeding the fluid from the feeding side to the pressure side.

19. The method of claim 18, wherein the fluid source is a fluid container, and further comprising the step of arranging the fluid container 0.1 to 2 m above a higher end of the pump segment, the fluid container communicating with the feeding side of the hose without an interposed pump.

20. The method of claim 12, wherein the peristaltic hose pump operates creates and maintains a fluid pressure limited to 500 mbar without a pressure measurement obtained by a pressure sensor during operation of the peristaltic hose pump.

* * * * *